United States Patent [19]

Arribau et al.

[11] 4,239,396

[45] Dec. 16, 1980

[54] METHOD AND APPARATUS FOR BLENDING LIQUIDS AND SOLIDS

[75] Inventors: Jorge O. Arribau, Englewood; Russell J. Dorn, Aurora, both of Colo.

[73] Assignee: Condor Engineering & Manufacturing, Inc., Henderson, Colo.

[21] Appl. No.: 6,277

[22] Filed: Jan. 25, 1979

[51] Int. Cl.[3] ..... B28C 5/16; B28C 5/13

[52] U.S. Cl. ..... 366/2; 366/40; 366/65; 366/168

[58] Field of Search ..... 366/6, 33, 34, 35, 38, 366/178, 180, 177, 159, 169, 76, 142, 172, 343, 2, 168, 65

[56] References Cited

U.S. PATENT DOCUMENTS

| | | | |
|---|---|---|---|
| 2,226,470 | 12/1940 | McGuffee | 366/343 |
| 2,392,542 | 1/1946 | Matuszak | 366/172 |
| 2,900,176 | 8/1959 | Krogel | 366/159 |
| 2,965,362 | 12/1960 | Flottmann | 366/169 |
| 3,158,358 | 11/1964 | Fischer | 366/169 |
| 3,256,181 | 6/1966 | Zingg | 366/142 |
| 3,584,840 | 6/1971 | Fuchs | 366/169 |
| 3,744,763 | 7/1973 | Zucker | 366/178 |
| 3,843,100 | 10/1974 | Haas | 366/76 |
| 3,848,507 | 11/1974 | Wisinski | 366/178 |
| 3,986,705 | 10/1976 | Navta | 366/169 |
| 3,998,433 | 12/1976 | Iwako | 366/178 |
| 4,045,004 | 8/1977 | Berger | 366/159 |

*Primary Examiner*—Robert W. Jenkins
*Attorney, Agent, or Firm*—John E. Reilly

[57] ABSTRACT

A high capacity blender has been devised which is adaptable for use in achieving the proper blend of liquid-to-liquid or liquid-to-solid constituents making up a gel composition for use in fracturing oil and gas well formations in which a high speed impeller is mounted for rotation concentrically within an outer casing and has a solids inlet which is isolated from the liquid inlet. A series of liquid inlet apertures are disposed in outer concentric surrounding relation to the impeller, and impeller vanes within the impellers are operative to impart a centrifugal force to solids introduced therein whereby to direct the solids and materials radially and outwardly under considerable force into the liquid stream which is directed axially along the inner wall of a mixing chamber. A preselected amount of the blended materials may be recirculated through the impeller inlet, and varying amounts of the solids in proportion to the liquid may be introduced through the impeller region while assuring intimate mixing with the liquid stream in a single stage for introduction under the desired pressure for pumping into the well.

19 Claims, 5 Drawing Figures

METHOD AND APPARATUS FOR BLENDING LIQUIDS AND SOLIDS

BACKGROUND OF THE INVENTION

This invention relates to a novel and improved blending method and apparatus adaptable for use in fracturing oil and gas well formations, and more particularly relates to a high capacity blending apparatus which is capable of achieving a proper blend of liquid-to-liquid or liquid-to-solid constituents in a single stage operation.

Oil and gas wells are fractured customarily by introduction of acids and gel compositions in multiple steps or a series of operations. At least certain of those steps require the introduction of solid granular or particulate material which must be thoroughly intermixed with a liquid prior to pumping into the formation. For instance, in the hydraulic fracturing of certain sandstones, typically a blender draws water from a series of storage tanks to intermix with sand, polymers or other chemical additives. The mixture is pumped under pressure deep into the subsurface formation through a perforated well casing to fracture the surrounding rock. When the polymerized liquid is later withdrawn from the formation, the sand is left in place to prop open the fracture. Gas or oil may then flow through the fracture to the well bore and into the pipe line for distribution.

In the past, among other approaches taken in blending of liquid and solid materials, generally the solids and liquids are intermixed by a paddle in a large open tub as a preliminary to pumping into the formation; or the liquids and solids are mixed together before they are advanced through the impeller zone of a blender. Moreover, conventional blending apparatus has generally required multi-stage blending, particularly in order to mix rather large quantities of liquid and solids or additives and to maintain them in suspension when pumped over the extended distances necessary to fracture the subsurface formations of the earth. Representative of such blenders which have been utilized in multi-stage operations is the patent to Zingg et al U.S. Pat. No. 3,256,181 wherein the liquid and particulate material are intermixed by swirling the liquid to impart a rotary motion and introducing the solid or particulate material near the center of rotation of the liquid and discharging the materials through an impeller under sufficient velocity to the solids to intimately mix with the swirling liquid. Here the impeller is employed both to cause swirling of the liquid in developing a predetermined head of pressure while introducing the solid material either into the same impeller or to a second rotating impeller for intermixture with the liquids at the second stage of the impeller unit. Blending apparatus has been employed also in mixing of cement and drilling mud in single stage operations and generally representative of such techniques are the U.S. Letters Patent to Owsley U.S. Pat. No. 2,147,053 and Raglan U.S. Pat. No. 2,626,788. In neither case however is the impeller so arranged that the solid inlet of the impeller is isolated from the liquid stream as the liquid stream is separately introduced in an axial direction toward the discharge end of the apparatus as solids are discharged by the centrifugal force of the impeller vanes into the liquid stream.

SUMMARY OF THE INVENTION

It is therefore an object of the present invention to provide a single stage blending apparatus which will achieve intimate mixing of liquid/liquid or liquid/solid costituents without altering the course or direction of liquid flow in establishing high capacity mixing and flow of the materials necessary for fracturing of oil and gas well formation.

Another object of the present invention is to provide a high capacity blending apparatus which can be truck-mounted or otherwise made portable and which is capable of intimately intermixing broad ranges of different sizes and types of solid materials with liquid materials in a simplified but highly dependable manner.

A further object of the present invention is to provide for cntinuously intermixing solid particulate materials with a high velocity axially directed liquid stream and specifically wherein the solid materials are forced through an inner zone isolated from the liquid zone by radially directing the solids under a centrifugal force sufficient to intercept the liquid stream and be held in suspension for pumping to the site of the intended use.

It is an additional object of the present invention to provide for a novel and improved blending method and apparatus for mixing liquid/liquid or liquid/solid constituents in which the relative proportions of the constituents may be closely controlled and varied according to the particular application without altering the operation of the system and wherein blending can be carried out in a continuous operation which is capable of blending over a wide range up to 6,000 gallons per minute; and further wherein selected amounts of the blended materials may be drawn off and recirculated as desired.

A preferred form of the present invention resides in a high capacity blending apparatus specifically adaptable for use in cementing wells or in fracturing oil and gas subsurface formations in which the apparatus is truck-mounted and has a solids inlet directed into a cylindrical casing which houses an impeller therein. The impeller is located in inner, spaced concentric relation to a series of liquid inlet ports or openings which are adapted to direct the liquid in the form of an axial stream along the inner wall of a mixing chamber or casing which is completely isolated from the solids inlet of the impeller. In turn, the impeller is mounted for rotation so as to impart a centrifugal force to the solids entering the impeller and to direct the solids radially in an outward direction into the fastmoving axial stream of liquid. The liquid is directed toward the discharge opening and as the solids are driven into the liquid stream are held in suspension in the liquid for discharge from one end of the apparatus opposite to the solids inlet. The mixing chamber converges away from the impeller zone into the discharge area and one or more discharge openings may be provided for connection to the suction side of one or more fixed displacement pumps for the purpose of pumping the liquid/solid blended material deep into the subsurface formation.

A recirculation inlet can be provided in the blending apparatus which communicates with the solids inlet and permits any excess of the liquid/solid material not pumped into the formation to be recirculated through the blender. The blender is capable of handling not only liquid/solid constituents but liquid/liquid constituents as well so that chemical additives may be introduced into the solids inlet port either in solid or liquid form for intimate mixture in the desired proportions with the high velocity liquid stream flowing axially along the inner wall of the casing. This axially moving stream of liquid generally is water which is supplied from water storage tanks at a convenient location close to the truck-mounted blender apparatus, and the solid material is sand which is advanced by an auger into the upper solids inlet for gravity flow into the inlet of the impeller. Isolation of the impeller inlet from the axially directed liquid stream enables the use of an auger within the blending apparatus at the inlet side of the impeller for preliminary mixing of solid materials and forcing them at a predetermined rate into the impeller zone for discharge into the liquid stream.

BRIEF DESCRIPTION OF THE DRAWINGS

Other objects, advantages and features of the present invention will become more readily appreciated and understood when taken together with the following detailed description in conjunction with the accompanying drawings, in which.

DETAILED DESCRIPTION OF THE PREFERRED EMBODIMENT

Figure 1:
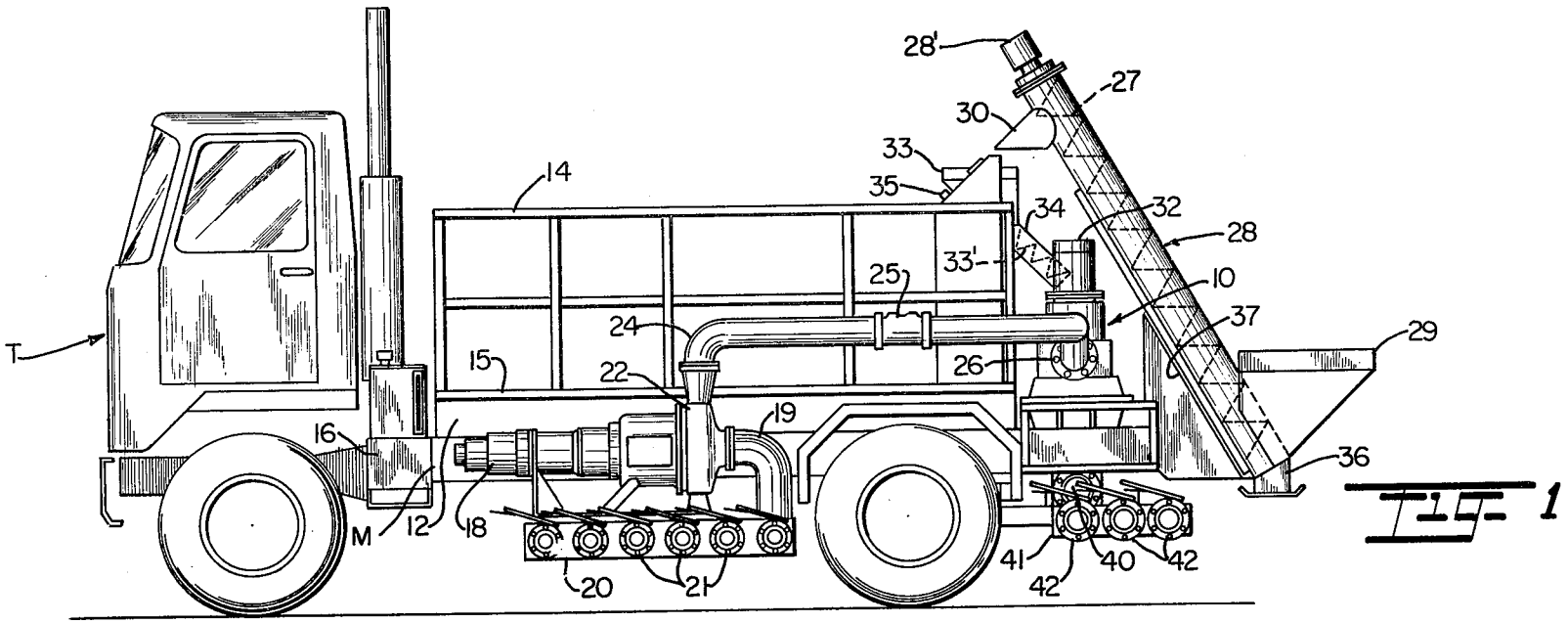
FIG. 1 is a side elevational view illustrating the installation of a preferred embodiment of the present invention on a truck.
Figure 2:
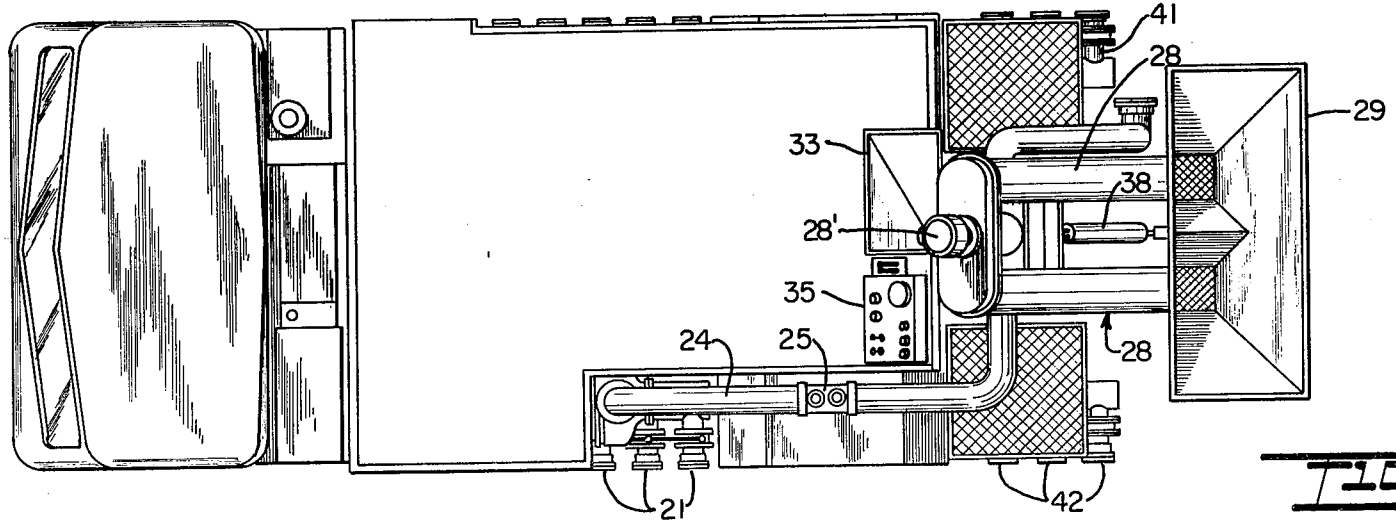
FIG. 2 is a top plan view of the truck-mounted installation shown in FIG. 1.

The preferred embodiment will be described with particular reference to its use either in cementing wells or fracturing oil or gas well formations and specifically in achieving the desired blend of liquid-to-liquid or liquid-to-solid constituents making up a gel composition which is employed in fracturing a subsurface formation. As a setting for the preferred embodiment of the present invention, a blender apparatus is generally designated at 10 and in FIGS. 1 and 2 is shown mounted on the rear end of a truck represented at T so that the blender is readily transportable to different well head sites and can be conveniently located with respect to water and oil stock tanks as well as to a supply of sand which is conventionally intermixed with the water or oil in formulating the fracturing composition preliminary to pumping it down into the well. Conventionally, the truck includes a main chassis represented at 12 having an open framework 14 positioned on the truck bed or platform 15 to support any pumps, conduits, valves and other accessories utilized in combination with the blender apparatus 10. For instance, as illustrated, a motor drive M having a hydraulic reservoir 16 is coupled in driving relation to a pump 18, the pump having a suction side 19 in communication with a manifold 20 which is adapted for connection with suitable conduits to water and/or oil stock tanks, not shown, located adjacent to the well head site. The delivery of water and oil is regulated by a series of valves 21 along opposite sides of the manifold which valves in a well-known manner are manually controlled to regulate the proportionate amount of water and oil supplied from the stock tanks into the suction side 19 of the pump.

The pump 18 also includes a discharge port 22 connected through delivery line 24 into an inlet port 26 on one side of the blender apparatus. A flowmeter 25 is located in the delivery line to indicate and to permit measuring the mass rate of flow of the liquid into the blender apparatus from the pump 18.

The solid or particulate material to be introduced into the blender may be delivered by various means. Preferably however in the delivery of sand into the blender apparatus, a pair of closely-spaced conveyor tubes 28 incline upwardly from a hopper 29, and an auger, 27, extends through each tubular conveyor 28 and is driven by a suitable hydraulic motor and chain drive mounted in the housing 28' at the upper end of the conveyors in order to advance the sand from the hopper 29 to the upper end of the conveyor. An outlet 30 at the upper end of the conveyor is aligned with an upper open end 32 which defines the solids inlet into the blender apparatus. In turn, a gravity feed hopper 33 is mounted on the open frame 14 of the truck and has a discharge spout or tube 34 inclining downwardly into communication with the interior of the solids inlet 32. The gravity feed hopper 33 is employed for the introduction of small amounts of chemical additives when desired, and the chemical additives are positively advanced by an auger 33' in the discharge spout 34. The feed or delivery of the sand and chemical additives is regulated by controlling the rotation of the delivery augers through a control panel represented at 35 on the upper end of the frame. In FIGS. 1 and 2, the conveyor assembly 28 is shown elevated with respect to the blender apparatus 10 for the purpose of transporting between different intended sites of use. However, when it is lowered into position with the upper end 30 aligned over the solids inlet 32, a lower leg 36 on the lower end of the conveyor will be in a position resting on the ground in order to support the conveyor assembly at the desired height both with respect to the supply source of sand and the upper solids inlet 32 of the blender. In this relation, the conveyor assembly 28 and hopper 29 is slidable along a support bracket 37 of generally triangular configuration which is mounted at the rear end of the truck bed. Raising and lowering of the conveyor 28 is effected by actuation of a hydraulic control cylinder 38 which, as illustrated in FIG. 2, interconnects the lower end of the hopper and the rearward extremity of the truck bed.

The blender apparatus 10 is provided with a lower discharge opening 40 which as illustrated in FIG. 1 is connected to a delivery line into a manifold 41 having a series of valves for discharge ports 42. These valves are connectable through one or more outlet lines into a fixed displacement pump, not shown, near the well head for the purpose of delivering the fracturing mixture from the blender. As discussed hereinafter in more detail with respect to the preferred form of blender apparatus, a corresponding discharge port 40 may be provided on the diametrically opposite side of the blender apparatus to the one shown in FIG. 1 for communication with a corresponding manifold 41 on the opposite side of the truck. The foregoing description of the various delivery and discharge lines leading into and from the blender apparatus, respectively, is given more for the purpose of illustration and not limitation so that a better appreciation may be gained of the ability of the blender apparatus to establish continuous, high capacity or mass rate of flow of the materials over a wide range while permitting controlled regulation of the desired proportion of the different ingredients or constituents making up the fracturing material.

Figure 3:
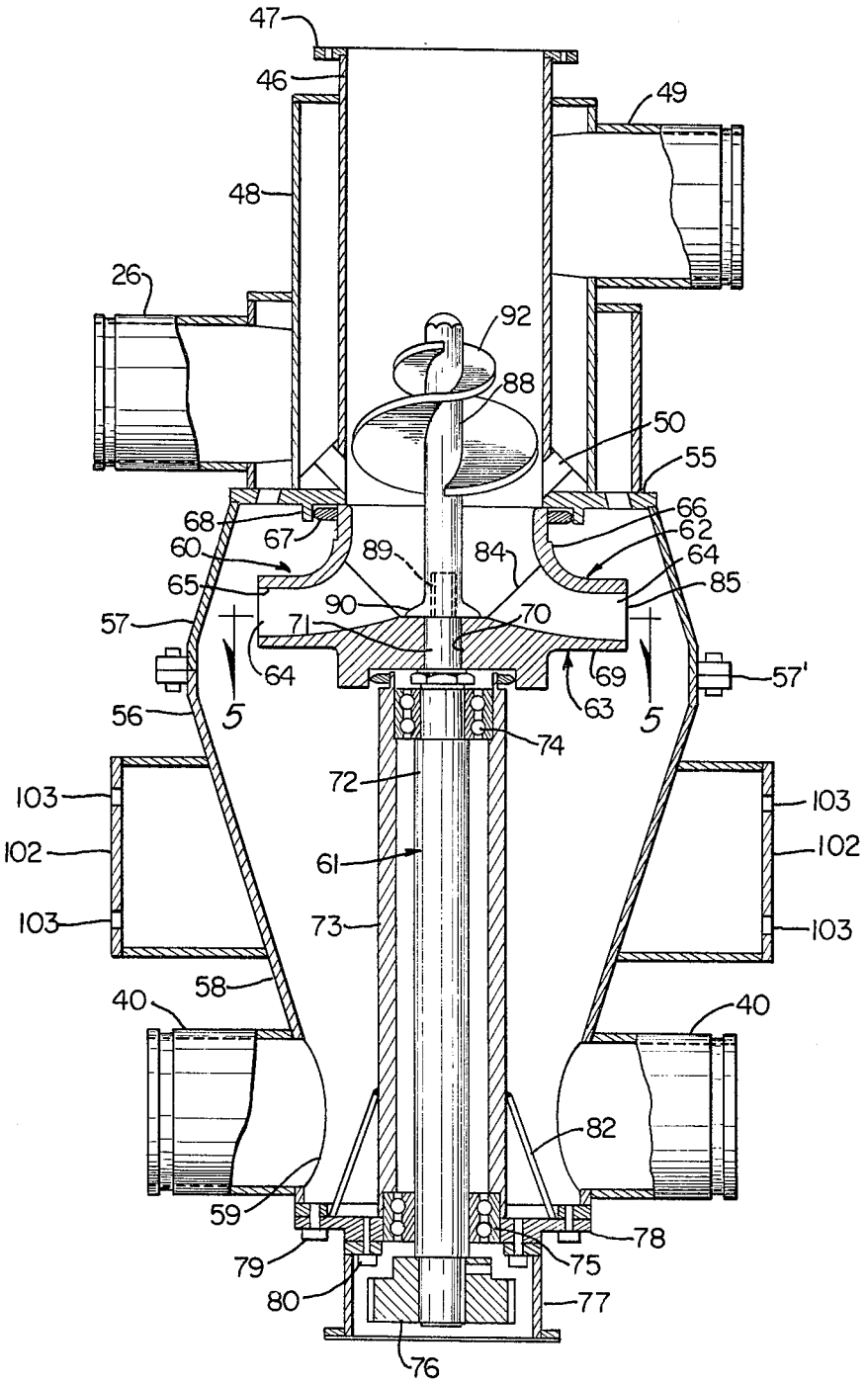
FIG. 3 is a cross-sectional view with portions broken away of a preferred form of blending apparatus in accordance with the present invention.

The preferred form of blender apparatus as shown in detail in FIG. 3 is characterized by establishing substantially a straight line axial flow of liquid through the blender while injecting a continuous high velocity stream of solid or particulate material under centrifugal force normal to the liquid stream. The solids are directed outwardly under sufficient force to encourage most complete mixture and suspension of the solid materials in the liquid stream preliminary to discharge from the blender through the manifold or manifolds 41. To this end, the blender apparatus is broadly comprised of a generally cylindrical casing or tubing 46, the upper end of which includes a connecting flange 47 adapted for attachment to the solids inlet 32. A casing 48 disposed in outer concentric relation to the casing 46 is in communication with a recirculation port or inlet 49 at its upper end and at its lower end communicates with the interior of the casing 46 through a series of spaced apertures 50. The water or base liquid inlet port 26 communicates with still another annulus 52 which is defined by a casing 54 disposed in outer concentric relation both to the inner and outer casings 46 and 48. The casing members 46, 48 and 54 as described all terminate at their lower edges on a common base plate 55 which forms the top wall of an enlarged mixing chamber 56, the latter being circular in cross-section and diverges downwardly as at 57 away from the outer peripheral edge of the base plate 55 for a limited distance. Connecting flanges 57' interconnect the lower edge of section 57 to a downwardly convergent section 58, and the section 58 converges into a lower end 59 of generally venturi-shaped configuration which is disposed opposite to or in alignment with the lower discharge ports 40.

In the preferred form, an impeller 60 is disposed for rotation on a drive shaft assembly 61 coaxially of the mixing chamber 56, the impeller having upper and lower spaced walls 62 and 63, respectively, which are spaced apart by radially extending vanes 64. The upper wall 62 has a radially outwardly extending horizontal section 65 which extends downwardly and away from an upper generally cylindrical opening 66. The latter forms an axial continuation of the lower end of the solids inlet 46 and is disposed in sealed relation to the base plate 55 by a rotary seal assembly 67 which is interpositioned between the upper extremity of the opening 66 and a downwardly projecting shoulder 68 on the plate 55. In turn, the lower wall 63 includes a radially outwardly extending wall section 69 in spaced parallel relation to the section 65 of the upper wall and a relatively thick central hub portion 70 which is keyed for rotation on upper reduced end 71 of drive shaft 72 forming the main drive member of the drive shaft assembly 61. The drive shaft 72 is journaled for rotation within an outer stationary sleeve 73 by upper and lower thrust bearings 74 and 75 with the lower end of the drive shaft being driven by a sprocket 76 which is partially enclosed within a housing 77. The sprocket 76 may be suitably driven by a chain drive off of a hydraulically-powered motor which for example may be capable of rotating the impeller with a tip velocity in the range of 200 to 5,000 rpms. The lower end of the sleeve 73 and outer race of the lower bearing 75 are permanently affixed to a bottom wall 78 of the mixing chamber, such as, by fasteners 79. Similarly the housing 77 is affixed to the bottom wall 78 by suitable fasteners 80 as shown in order to effect a complete seal between the chamber 56 and drive shaft assembly. Additionally, a downwardly divergent skirt 82 is positioned to extend from the external surface of the sleeve downwardly to abut against the bottom wall 78 of the mixing chamber to encourage outward flow of the mixed material from the mixing chamber into the discharge ports 40.

Preferably the vanes 64 are in the form of arcuate, generally radially extending blades, each blade having an inner inclined edge 84 and being curved or bowed along its length to terminate in an outer vertical edge 85 flush with the outer extremities of the upper and lower wall sections 65 and 69. The vanes are bowed in a direction to present a convex surface in the direction of rotation of the impellers so as to encourage the outward movement of the solid material and to impart a high velocity to the material as it is driven through the impeller region under centrifugal force into the axially moving liquid stream. At the same time the impeller 60 isolates the solids inlet from the liquid stream in order that mixing of the materials is brought about only at the point of high velocity discharge of the solids from the outer radial extremities of the impeller into the axially moving liquid stream and in a direction normal or perpendicular to the direction of flow of the liquid stream. This has been found to encourage more intimate mixing and suspension of the solids materials in the liquid stream so that as the stream is caused to undergo an increase in velocity in traveling downwardly through the convergent wall section 58 of the mixing chamber the solids will be carried with the stream through the discharge ports and not tend to build up or collect in the mixing chamber itself.

In handling certain particulate materials, it may be desirable to employ an auger assembly within the solids inlet; and to this end, an auger drive shaft 88 is provided with a threaded counterbore 89 for threaded connection to upper threaded end 90 of the drive shaft assembly 61. Auger 92 has spiral flighting of progressively reduced diameter in a direction away from the lower end of the auger drive shaft 88 so that as the auger is rotated it will encourage downward movement of the particulate materials introduced into the solids inlet at a controlled rate of flow into the impeller region. Accordingly, the auger will minimize any possibility of jamming or lodging of the materials within the solids inlet above the impeller region.

As shown in FIG. 3, the intermediate annulus 48 is in communication with a recirculation port 49 adjacent to the upper end of the solids inlet and, by reference to FIG. 2, it will be seen that the recirculation port is connected into a recirculation line 96 which although not shown is adapted for connection to the discharge side of the suction manifold of the fixed displacement pump near the well head. This pump for example may be a triplex plunger pump Model GT 78-1000 manufactured and sold by O.P.I., Inc. of Odessa, Tex. In certain applications, it may be desirable to recirculate a selected proportion of the blended or mixed materials discharged from the blender apparatus and this is most effectively accomplished by connecting the recirculation line 96 to the discharge side of the pump. Thus any materials not pumped directly into the well will be discharged back through the recirculation line and carried into the annulus 48 through the apertures or canted nozzles 50 which are in communication with the interior of the solids inlet adjacent to its lower end directly above the impeller inlet. In this manner, the recirculated material is intermixed with the solid particulate material introduced through the solids inlet as a preliminary to being discharged into the mixing chamber.

Suitable mounting or supporting fixtures are provided on the external housing of the blending apparatus and, as shown in FIG. 3, a hollow, generally circular frame 102 is permanently affixed to the outer wall of the mixing chamber and is provided with spaced openings 103 at spaced intervals around the external vertical wall of the support to facilitate attachment to mounting arms or brackets on the rear end of the truck.

EXAMPLE 1

In the method of employing the blending apparatus shown in FIG. 3 for a typical application in fracturing of an oil well, the operation may be performed in four stages: In the first stage, 500 gallons of 2% KCl and water (percent measured by weight ratio is 175 lbs. of KCL per 1,000 gallons of water) is done to load the hole and to test the lines to the well head. Here the water is introduced through the inlet port 26 under a pressure of 60 to 100 psi and the KCl additive is introduced through the solids inlet for continuous intermixture with the water stream passing across the discharge of the impeller. In the second stage, 500 gallons of 7½% HCl is provided with 20 lbs. per 1,000 gallons of citric acid (200 mesh) for the purpose of cleaning the casing perforations. Following the second stage, 30,000 gallons of water are pumped through the blending apparatus and are gelled with 40 lbs. of guar gum per 1,000 gallons of water (the guar gum consisting of guar beans ground to 200 mesh size), and 75,000 lbs. of 10 to 20 mesh sand. Preferably the materials are mixed or blended by beginning with 0 lbs. per gallons concentration and increasing by 1 lb. per gallon of sand for every 5,000 gallons of fluid pumped into the well. Finally, 500 gallons of 2% KCl are introduced to displace all the fluid and sand into the formation. For instance, when the impeller is rotated at a speed of 1,000 rpm the mixture delivered at the rate of 25 barrels per minute at 50 psi from the blender.

EXAMPLE 2

To illustrate the versatility of the blending apparatus it may be employed with various different types of fracturing operations where the combination of acid or gel is to be delivered into the formation together with sand in suspension whereby the sand is left in the formation and the gel is removed following the introduction of sand. For instance, the chemical additives required in making up the gel may be introduced through the solids inlet together with the sand and intermixed over a broad range of concentration. For the purpose of illustration, a 2% concentration of KCl is introduced again to load the hole and test the lines to the well head, following which 5,000 gallons of gel are blended and introduced into the formation. Thereafter, increasing concentrations of the same gel with 2 lbs. per gallon of 100 mesh sand are blended and introduced, and successively 10,000 gallons of gel with 2 lbs. per gallon of 20 to 40 mesh sand, 10,000 gallons of gel with 3 lbs. per gallon of 20 to 40 mesh sand, and 10,000 gallons of gel with 4 lbs. per gallon of 20 to 40 mesh sand are successively delivered into the formation. The formation was then flushed with 113 barrels of water to displace all the gel from the tubing of the casing; 2 barrels per minute of liquid $CO_2$ was added throughout the job with a high pressure pump.

EXAMPLE 3

In a three-stage operation, 750 gallons of 7 ½% HCl are introduced for the purpose of cleaning the casing perforations and residual drilling mud. 5,000 gallons of gel are first introduced with no sand, following which 4,000 gallons of gel with 4,000 lbs. of 40 to 60 mesh sand are introduced and thereafter 20,000 gallons of gel with 50,000 lbs. of 20 to 40 mesh sand are introduced. Again, the introduction of the 20,000 gallons of gel as last stated may be done by increasing concentrations of 1 lbs. per gallon and increasing same by 1 lb. per gallon every 5,000 gallons of gel so that the last 5,000 gallons of gel will have a concentration of 4.0 lbs. per gallon. Stages 2 and 3 may be repeated two more times before the well is flushed with water containing a 2% concentration of KCl. The acid and gel are successively pumped in the three stages described at a rate of 25 barrels per minute (1,050 gallons per minute) utilizing three 1,000 hp pumping units connected through the discharge manifold 41 from the blending apparatus 10.

Figure 4:
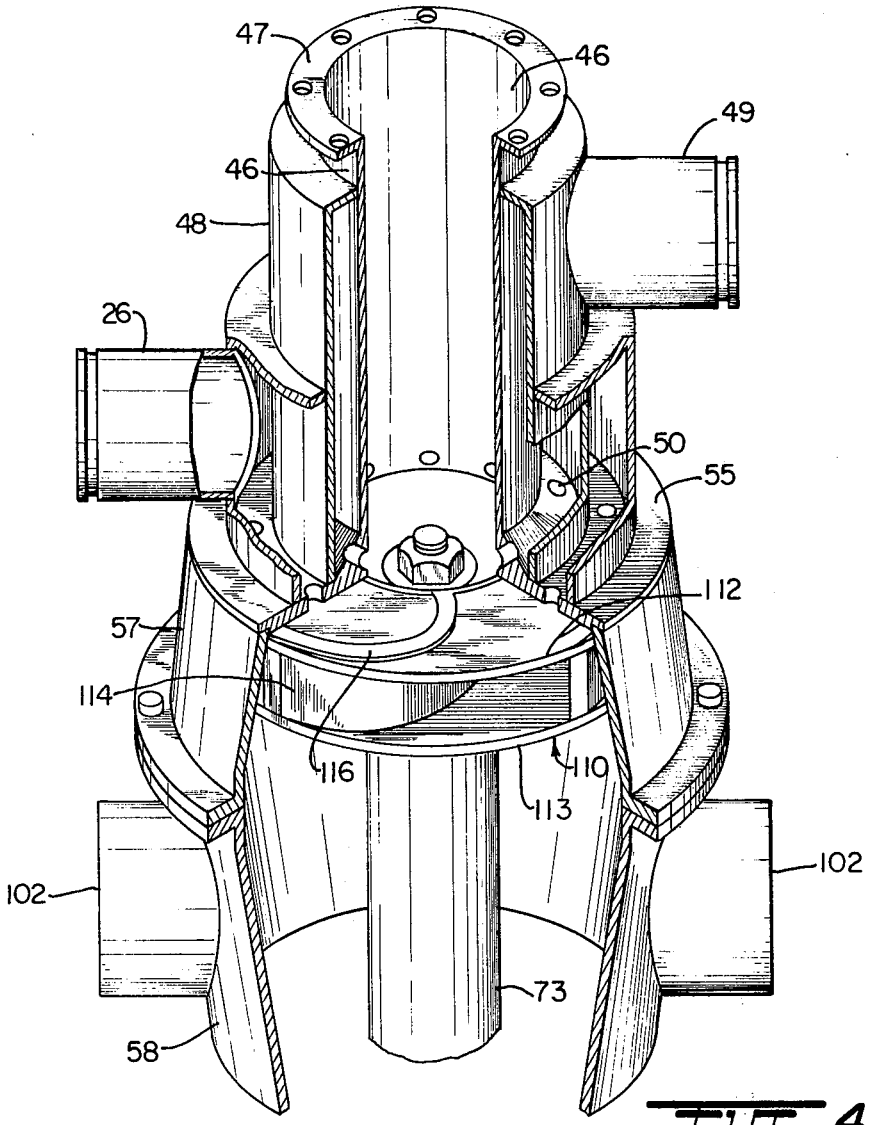
FIG. 4 is a somewhat perspective view with portions broken away of a modified form of impeller in accordance with the present invention.
Figure 5:
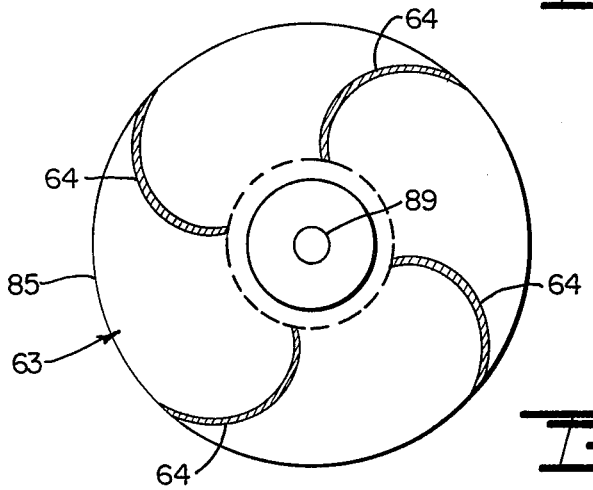
FIG. 5 is a cross-sectional view of the impeller shown in FIG. 3.

A modified form of invention is illustrated in FIG. 4. In the modified form, like parts are correspondingly enumerated and the modification specifically resides in utilization of an impeller 110 having upper and lower plates 112 and 113, respectively, which enclose a series of vanes 114 at equally spaced circumferential intervals around the central axis of the impeller. The configuration of the vanes 114 as well as the upper and lower plates 112 and 113 corresponds to that shown in more detail in FIG. 3; however, in order to obviate the use of seals between the solids inlet and upper wall of the impeller, the impeller is merely stationed directly beneath the solids inlet 46 and the upper wall 112 of the impeller is provided with a series of ribs 116 at spaced circumferential intervals corresponding to that of the vanes. The ribs 116 are similarly bowed or of arcuate configuration and are aligned to rotate in closely-spaced relation to the undersurface of the base plate 55. In this manner, the ribs will resist or counteract any tendency of the liquid stream flowing through the liquid inlet 26 to flow or seep between the impeller and the base plate 55 into the inlet side of the impeller. In this way, the impeller will effectively isolate the introduction of solids at the inlet of the impeller from the introduction of liquid through the mixing chamber. The blending apparatus 110 is also modified in the respect that it is employed without an auger so that the solid materials are free to pass directly into the eye of the impeller and have their delivery rate controlled by the separate augers 27 and 33' as earlier described.

Although the present invention has been described with particularity relative to the foregoing detailed description of the preferred embodiment, various modifications, changes, additions and applications other than those specifically mentioned herein will be readily apparent to those having normal skill in the art without departing from the spirit and scope of the invention.

We claim:

1. The method for continuously intermixing solid particulate material with a liquid comprising the steps of:

axially directing a liquid stream through a liquid conduit in outer concentric relation to a solids inlet conduit; and axially directing solid particulate material through the inner solids conduit and discharging the solid particulate material from the solids conduit into the inlet of an impeller zone which is isolated from the liquid stream, and radially directing the solids through the impeller zone under a centrifugal force sufficient to intercept the liquid flowing through the inlet conduit and become intimately intermixed with the liquid stream for discharge of the solid materials under liquid suspension through a common discharge outlet.

2. The method according to claim 1 wherein the liquid is directed axially along the inner wall of an annulus isolated from the solids conduit under a pressure of 10 to 200 psi.

3. The method according to claim 1 wherein the solid material is directed axially through the inner conduit solids in the same direction as the liquid stream.

4. The method according to claim 1 in which the solids are composed of sand which is directed through the inner solids conduit in the ratio of 8 to 10 lbs. per gallon of the liquid.

5. The method according to claim 1 in which the liquid stream is introduced at a pressure of 10 to 200 psi and directed through circumferentially spaced axial passageways into a downwardly divergent mixing chamber.

6. The method according to claim 1 in which the solids are driven outwardly in a radial direction through the impeller zone while being caused to undergo rotation at speeds on the order of 200 to 5,000 rpm.

7. The method according to either of claims 1 or 6 wherein the liquid and solids in suspension are discharged through a mixing chamber first diverging then converging away from the area of intermixture between the liquid and solids into a venturi-shaped outlet.

8. The method according to claim 1 in which a selected proportion of the liquids and solids is recirculated through said solids inlet conduit.

9. The method according to claim 8 in which the recirculated liquid and solids are directed through a plurality of nozzles canted inwardly into said solids inlet conduit.

10. An impeller apparatus adapted for mixing solid and liquid materials comprising:

a solids inlet defined by a generally cylindrical casing;

an impeller mounted for rotation about an axis coaxial with said cylindrical casing including an upper chamber in open communication with said solids inlet, and impeller vanes operative to impart a centrifugal force to solids entering said chamber whereby to direct the solids radially and outwardly through a radial opening outlet;

a liquid conduit disposed in outer concentric relation to said solids inlet and impeller including means for introducing liquid under pressure into said liquid inlet whereby to direct the liquid axially in a high velocity stream in outer spaced concentric relation to said radially opening outlet means for introducing liquid under pressure into said liquid; and sealing means associated with said impeller to isolate said solids inlet from said high velocity stream of liquid flowing through said liquid conduit, the solids being directed outwardly in a path normal to the axial stream of liquid so as to be entrained and fully intermixed with said high velocity stream.

11. An impeller apparatus according to claim 10, including axially directed openings in outer circumferentially spaced relation to the inlet of said impeller.

12. An impeller apparatus according to claim 10, said inner concentric cylindrical casing disposed in contiguous surrounding relation to the inlet of said impeller whereby to isolate the inlet of said impeller from said liquid conduit.

13. An impeller apparatus according to claim 10, including upper and lower spaced plates, said impeller vanes extending radially between said upper and lower spaced plates, said upper plate being provided with a central opening centered with respect to said solids inlet, and sealing means interposed between said upper plate and said solids inlet.

14. An impeller apparatus according to claim 10, including a mixing chamber disposed in outer concentric relation to said impeller, a drive shaft extending axially through said mixing chamber and drivingly connected to said impeller, said impeller including a housing for said impeller vanes, said housing including a central opening in communication with said mixing chamber, and radially extending ribs at spaced circumferential intervals between said housing and said solids inlet, said ribs being rotatable with said impeller whereby to prevent passage of liquid from said mixing chamber into said solids inlet.

15. An impeller apparatus according to claim 14, said impeller vanes and said auger having a common drive shaft.

16. An impeller apparatus according to claim 10, further including a solids conveyor adapted to introduce solid materials under gravity into the upper open end of said inner chamber.

17. A vehicle-mounted blender apparatus adapted for mixing solid and liquid materials comprising:

a solids inlet defined by a generally cylindrical casing;

an impeller mounted for rotation about an axis coaxial with said cylindrical casing including an upper chamber in open communication with said solids inlet, and impeller vanes operative to impart a centrifugal force to solids entering said chamber whereby to direct the solids radially and outwardly through a radially opening outlet;

a liquid inlet disposed in outer concentric relation to said impeller provided with axially directed openings to direct the water axially in a high velocity stream in outer spaced concentric relation to said radially opening outlet, means for introducing liquid under pressure into said liquid inlet, and the solids being directed outwardly in a stream normal to the axial stream of liquid so as to be entrained and fully intermixed with said high velocity stream; and a recirculating passageway concentrically disposed between said liquid inlet and impeller for directing a predetermined proportion of the intermixed solids and liquid stream through said impeller zone.

18. A vehicle-mounted blender apparatus according to claim 17, including conveyor means for delivering solids to said solids inlet, means for adjustably mounting said conveyor means with respect to said blender apparatus, and vehicle-mounted liquid supply means including a pumping unit communicating with a source of liquid supply and operative to deliver liquid under pressure to said liquid inlet.

19. A vehicle-mounted blender apparatus according to claim 18, said conveyor mounting means including a vehicle-mounted bracket positioned adjacent to said blender apparatus having a downwardly and outwardly inclined support surface for said conveyor, and actuating means associated with said conveyor means operative to selectively raise and lower said conveyor means between a ground-engaging position in which the upper end of said conveyor means is aligned with said solids inlet and an elevated position above the ground.

* * * * *